US007922608B1

(12) United States Patent
Shoham

(10) Patent No.: US 7,922,608 B1
(45) Date of Patent: Apr. 12, 2011

(54) TENNIS BALL RETRIEVAL, STORAGE AND DISPENSING DEVICE

(76) Inventor: Jonathan C. Shoham, Simsbury, CT (US)

( * ) Notice: Subject to any disclaimer, the term of this patent is extended or adjusted under 35 U.S.C. 154(b) by 500 days.

(21) Appl. No.: 11/906,986

(22) Filed: Oct. 5, 2007

(51) Int. Cl.
*A63B 47/02* (2006.01)

(52) U.S. Cl. ..... 473/460

(58) Field of Classification Search ..... 473/460, 473/464, 553; 294/19.2
See application file for complete search history.

(56) References Cited

U.S. PATENT DOCUMENTS

| | | | | | |
|---|---|---|---|---|---|
| 2,760,807 | A * | 8/1956 | Watson | 294/19.2 |
| 4,058,336 | A * | 11/1977 | Parkinson | 294/19.2 |
| 4,610,373 | A * | 9/1986 | Sherbondy | 221/155 |
| 5,188,410 | A * | 2/1993 | Summers | 294/19.2 |
| 5,292,161 | A * | 3/1994 | Green | 294/19.2 |
| 5,335,953 | A * | 8/1994 | Luther, Sr. | 294/19.2 |
| 5,433,491 | A * | 7/1995 | Green | 294/19.2 |
| 5,505,510 | A * | 4/1996 | Duncan | 294/19.2 |
| 5,634,680 | A * | 6/1997 | Green | 294/19.2 |
| 5,755,632 | A * | 5/1998 | Eddy | 473/460 |
| 5,775,751 | A * | 7/1998 | Nelson | 294/19.2 |
| 2002/0151390 | A1* | 10/2002 | Niksich | 473/460 |
| 2005/0052040 | A1* | 3/2005 | Hellerson | 294/19.2 |
| 2005/0230984 | A1* | 10/2005 | Seefeldt et al. | 294/19.2 |
| 2007/0111829 | A1* | 5/2007 | Verga | 473/517 |
| 2008/0185855 | A1* | 8/2008 | Compton | 294/19.2 |
| 2009/0108601 | A1* | 4/2009 | Lee | 294/19.2 |

* cited by examiner

*Primary Examiner* — Raleigh W. Chiu
(74) *Attorney, Agent, or Firm* — Joseph E. Funk

(57) ABSTRACT

A tennis ball retrieval, storage, and dispensing device is disclosed having a hollow tube with a diameter that may be larger than balls that are to be picked up and stored within the tube. With the larger diameter tube the balls are staggered therein so more balls may be held in a given length of tube. Positioned at the top of the hollow tube is a closed end cap that is opened to remove balls stored inside the tube. Attached to the bottom of the hollow tube is an entrance end cap that has an opening that may be of different shapes but a round tennis ball entering the device tube through the entrance end cap opening must be squeezed to a non-round shape to get past the opening and enter the device tube. A retainer is mounted inside the entrance end cap past the opening that also squeezes tennis balls entering therein. The retainer assures that tennis balls that have been retrieved with the device do not hang out below the entrance cap opening. The end caps and the tube may have a triangular cross sectional shape which prevents the device from rolling on the ground. In addition, when the device tube has a circular cross section two tubes may be utilized that can telescope inside each other and their position held by a locking device.

18 Claims, 5 Drawing Sheets

TENNIS BALL RETRIEVAL, STORAGE AND DISPENSING DEVICE

FIELD OF THE INVENTION

The present invention relates generally to a tennis ball retrieval, storage and dispensing device. In particular, the present invention relates to a tennis ball retrieval, holding, storage and dispensing device that allows a user to retrieve tennis balls off the ground, store the tennis balls, and, when needed, to dispense the tennis balls.

BACKGROUND OF THE INVENTION

It is not uncommon for a plurality of tennis balls to be present on a tennis court at one time during a typical practice session of tennis. Once a session is complete or all the balls are used they must be picked-up in order to continue play. This is done not only for the safety of the players, but also to also keep the tennis court free of tennis balls. In the case of tennis practice, time studies have determined that far more time is typically spent in retrieving tennis balls from a court than the time actually spent in hitting the tennis balls during practice. In order to retrieve the tennis balls from the court, the player typically has to pick up each individual tennis ball by hand. This usually means that the player must squat or bend down each time a ball is picked up. This is very stressful and potentially damaging to back and leg muscles.

In addition to squatting or bending down a great number of times to individually pick up many tennis balls, the player has to walk to a specific location where the balls are being stored, e.g., a tennis ball bin. Balls are stored in the bin for future retrieval of balls during practice or a set of tennis. This takes many trips across the court since the player can only hold a limited amount of tennis balls at one time. This process is very frustrating and time consuming to the player.

Tennis ball retrieval systems, however, have been devised to assist the player in retrieving tennis balls that are on a court. Typically the tennis ball retrieval systems are complex systems that assist the tennis player in retrieving tennis balls during play. This permits the user to play with a limited number of tennis balls without the worry of having to manually retrieve the balls. These systems are difficult to install and in most instances are a permanent feature to the tennis court.

These systems usually consist of troughs that run the length of the tennis net and side courts. In addition to the troughs are conveyors and other complicated retrieval mechanisms such as ball stackers and holding systems. Only the most exclusive clubs have tennis courts equipped with such ball retrieval systems due to the expensive nature of these systems and their installation.

Many manual tennis ball retrieval and storage devices have also been invented. Most of these retrieval devices are tubes with caps and on their ends to pick up, hold and dispense tennis balls. However, when such devices are laid on the ground they can roll. In addition, the weight of balls inside the device cause the bottom most ball to protrude out of the bottom opening through which balls enter the device.

To overcome the shortcoming of manual prior art tennis ball retrieval, storage and dispensing devices described in the previous paragraph an improved manual tennis ball retrieval and storage device is needed.

SUMMARY OF THE INVENTION

The previously described shortcomings in prior art manual tennis ball retrieval, storage and dispensing devices is solved by the present invention. A modular tennis ball pick-up and storage device is disclosed that can be modified to meet the desires of a user.

The novel device of the present invention has a hollow tube that has an inside dimension that is larger than the diameter of tennis balls that are stored inside the tube. The tube may have a cross sectional shape that is round, or triangular with the three pointed triangle peaks being rounded and the three sides being rounded outwardly.

There are caps on either end of the hollow tube. On the top of the tube is mounted a closed end cap that retains tennis balls inside the tube, and the cap is opened to retrieve the tennis balls from inside the tube. The cap may screw on, snap on or it may be a flip top cap. The closed end cap may have a shape that is circular or triangular.

On the bottom of the tube is mounted an entrance end cap that has an opening there through. The opening may be round, or may have a non-round shape including being generally triangular shaped. For a round opening it will have a diameter slightly less than 2½ inches, which is the diameter of the smallest specification tennis ball. The cross sectional shape of the non-round openings through the entrance cap is small enough that tennis balls must be squeezed a small amount to pass through the opening and enter the interior of the tube of the ball retrieval, storage and dispensing device. This is done when the opening of the entrance end cap on the bottom end of the tube is pushed downward over a tennis ball. The ball is deformed a small amount to pass through the opening through the entrance end cap. When a tennis ball is inside the tube of the device it cannot exit the tube back through the same entrance end cap opening. It must be removed by opening the closed cap on the top of the tube. The entrance end cap may have a shape that is circular, oval, triangular or other shape.

For the sake of aesthetic appearance the device tube may have a cross sectional shape that is triangular and the caps at either end, top and bottom, of the tube may also have a generally triangular shape. This triangular shape of the end caps prevents the ball retrieval, storage and dispensing device from rolling when it is laid down on the ground or other surface, no matter if the tube is round, triangular or any other shape.

Attached to an inside wall of the entrance cap, near the opening, is a retainer that impacts the side of a tennis ball as it passes through the cap opening and into the tube. The retainer also squeezes a ball entering the tube a small amount. When a ball is flush with the opening through the entrance cap the pressure on the ball caused by the retainer holds the ball in place and prevents the ball from extending out of the bottom of the tube, even with the weight of other balls in the tube on the lower most ball.

The round storage tube of the ball retrieval, storage and dispensing device comprises two cylindrical tubes that have slightly different diameters and the smaller diameter tube can just slide inside the larger diameter tube in a telescoping action. This telescoping action permits an empty device to be shortened to its shortest length for storage of the device, and also permits the device to be telescoped to accommodate the actual number of balls actually stored inside. A threaded flange called a tube enlarger is attached utilizing an adhesive to the outside of an end of the larger diameter tube segment opposite the end with a cap. Over the end of the smaller diameter tube, that slides inside the larger diameter tube, is slipped both an elastic compression ring and a coupler nut. When the coupler nut is loose the two tubes can telescope together to either increase or decrease the overall length of the device. When the coupler nut is screwed onto the threads of the tube enlarge and tightened the compression ring is squeezed between the two tubes and the tubes are locked in their telescoped position.

When the storage tube has a triangular cross sectional shape that is significantly larger than the diameter of balls stored inside the tube, the balls will be staggered in the tube which permits a greater number of balls to be stored within a given length of tube. The retainer assists in the tennis balls being stacked inside the tube in a staggered fashion by placing a force on the balls transverse to the direction they travel as they enter the device.

DESCRIPTION OF THE DRAWINGS

The invention will be better understood upon reading the following Detailed Description on conjunction with the drawing in which.

DETAILED DESCRIPTION

Figure 1:
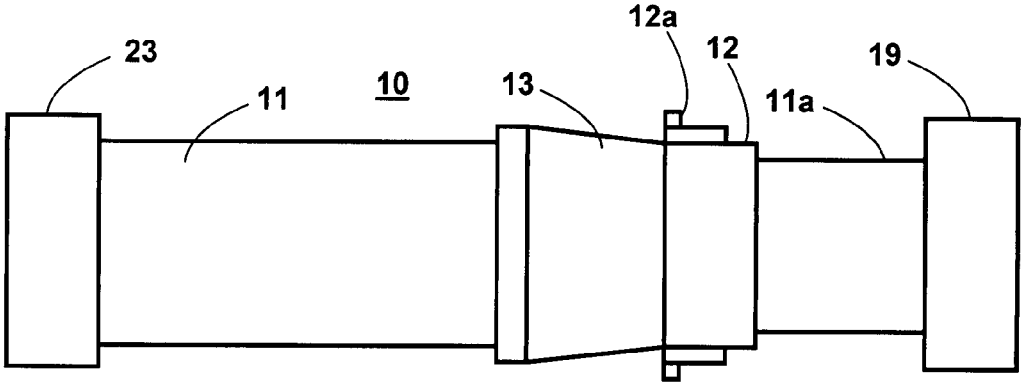
FIG. 1 shows a side view of the ball retrieval, storage and dispensing device.
Figure 9:
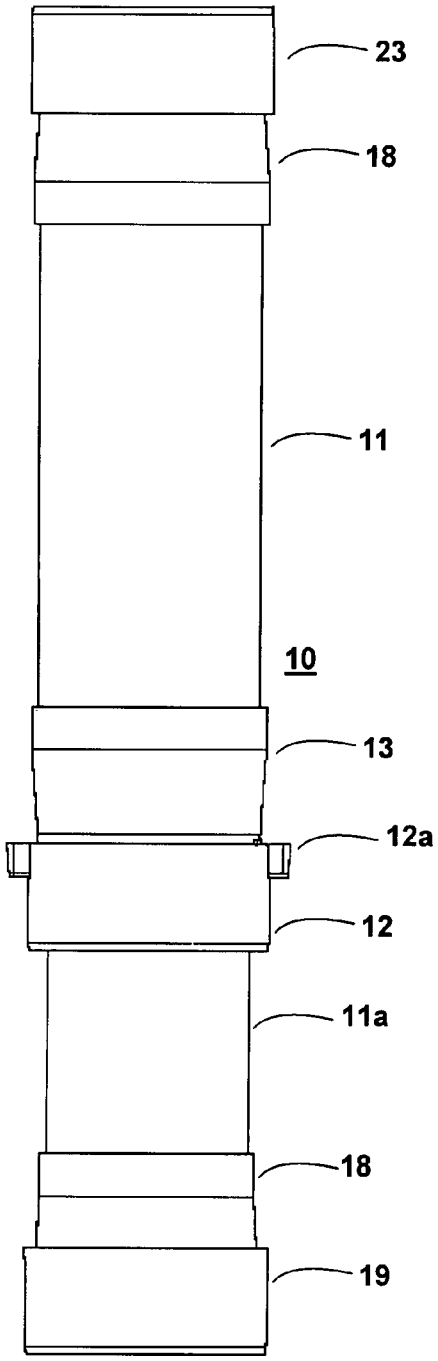
FIG. 9 is a side view of a ball retrieval, storage and dispensing device having screw on closed end caps mounted thereon.
Figure 15:
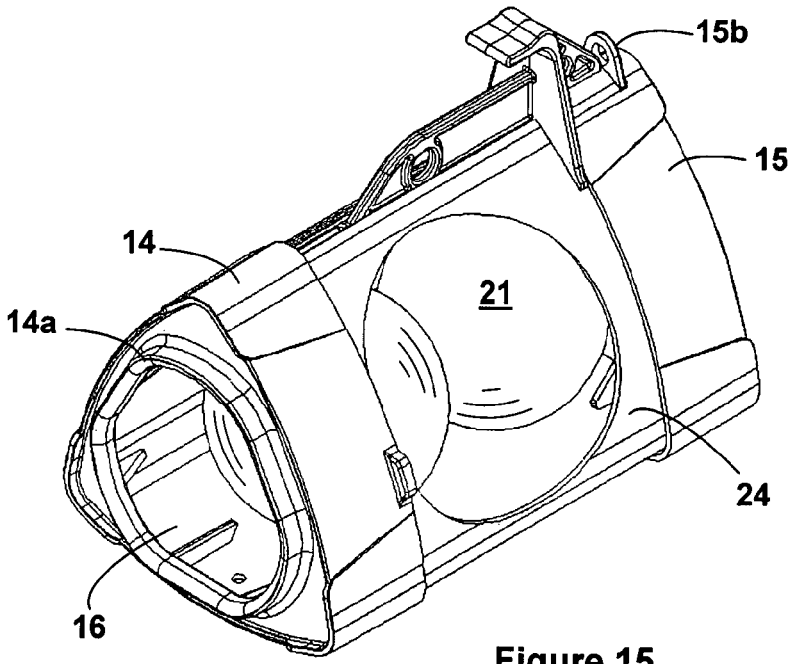
FIG. 15 is a three dimensional, contracted view of a ball retrieval, storage and dispensing device having a storage tube that has a triangular cross section and triangular end caps.

The present invention is a modular ball retrieval, storage and dispensing device that can be easily modified to meet the needs of a user. The device may have circular cross sectional ball storage tubes that can telescope together, such as shown in FIG. 1, or may have a triangular cross sectional ball storage tube such as shown in FIG. 15. The modular device also has end caps that have either a circular or triangular cross section such as shown in FIGS. 9 and 15 respectively. One end cap is an entrance end cap that has an opening through which balls enter the device and the entrance end cap has a novel retainer tab mounted inside it that holds a ball far enough inside the storage tube and entrance end cap so that the ball does not hang or protrude through the opening of the entrance cap.

In FIG. 1 is shown a side view of one embodiment of the ball retrieval, storage and dispensing device 10 having round tubes 11 and 11*a* for storage of tennis balls. It comprises a length of larger diameter tube 11 and a length of smaller diameter tube 11*a*. The inside diameter of tube 11*a* is 3.05 inches and its outside diameter is such that it can just slide or telescope inside larger diameter tube 11. To adjust and lock the total length of tubes 11 and 11*a*, a tube enlarger 13, compression ring 17 (not shown in FIG. 1) and a coupler nut 12 are utilized. These pieces are shown in and described with reference to FIGS. 12, 13 and 17.

Tube enlarger 13 is fastened by an adhesive, or otherwise, to the end of larger diameter tube 11 that is at the middle of device 10. Coupler nut 12 and compression ring 17 are slid onto the end of smaller diameter tube 11*a* closest to the middle of device 10. As internal threads of coupler nut 12 (See FIG. 5) are screwed onto external threads 13*a* of tube enlarger 13 (See FIG. 3) the compression ring 17 is squeezed and locks the two tubes together so they do not telescope. To assist in tightening coupler nut onto tube enlarger 13 there are at least two small, opposing protrusions 12*a* on the outside of coupler nut 12 as shown.

Figure 10:
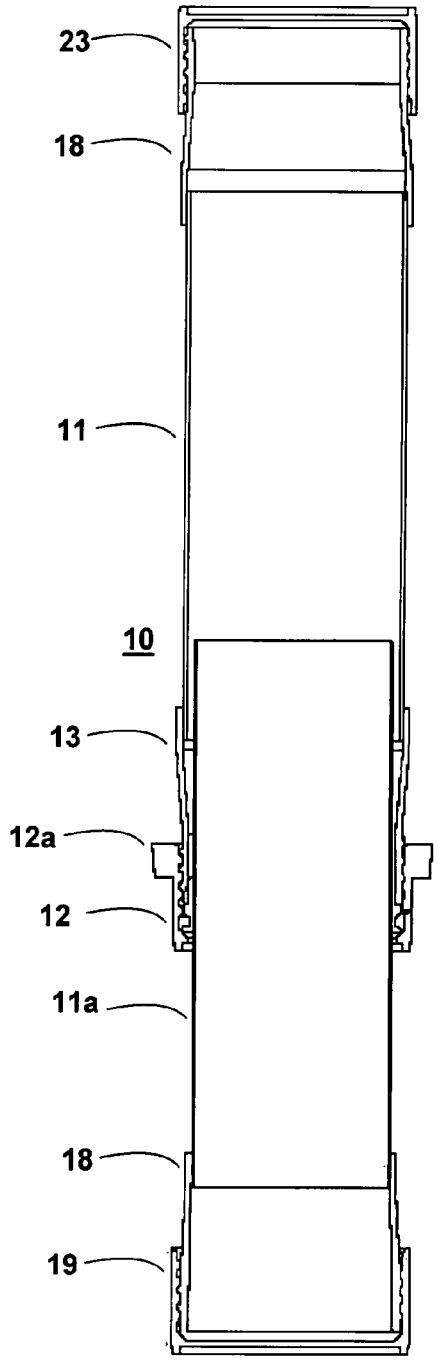
FIG. 10 is a side cutaway view of a ball retrieval, storage and dispensing device having screw on closed end caps mounted thereon.

At the left end of device 10 is fastened a circular entrance cap 23 that is shown in and described in greater detail with reference to FIG. 7. Tennis balls enter tube 11 through a hole 23*a* in the end of entrance cap 23 (See FIG. 7). At the right end of device 10 is fastened a closed entrance cap 19 that is shown in and described in greater detail with reference to FIG. 8. Both of these caps can be attached to the ends of tubes 11 and 11*a* as shown in FIGS. 9 and 10 utilizing tube reducers 18. In this mode of attachment the end caps 19 ands 23 are screwed on as may be seen in FIG. 10. However, other means of attachment, such as snap on, may be utilized for both end caps. Closed end cap 19 must be removed to extract tennis balls picked up and stored inside the tubes 11 and 11*a* of device 10. However, a different cap (not shown) may be provided which is more permanently attached to the right hand end of tube 11*a* which has a spring loaded, flip open cover. Such caps are known in the prior art.

In use of device 10 the entrance 23*a* (see FIG. 7) of entrance end cap 23 is pressed down on a tennis ball 21 which passes through opening 23*a* of entrance end cap 23 and enters into larger diameter tube 11 where it is retained. The ball 21 cannot exit tube 11 back through entrance cap 23.

Figure 2:
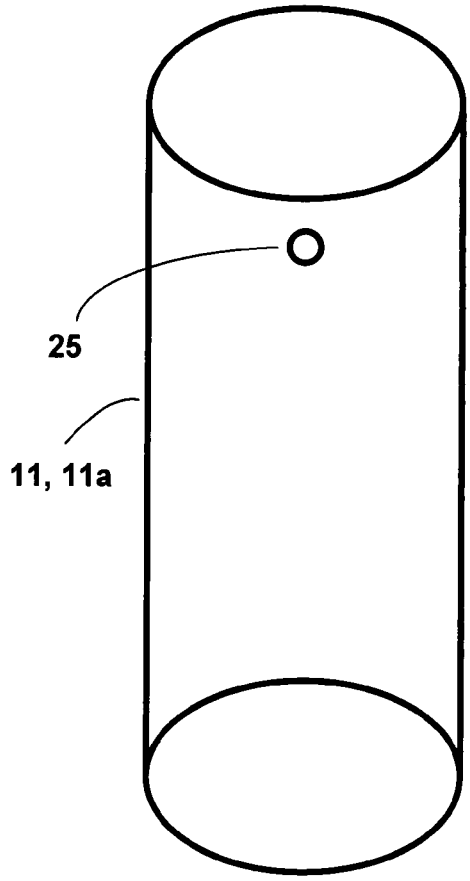
FIG. 2 is a three dimensional view of the circular cross section tubes used in the device.

In FIG. 2 is shown a cylindrical, hollow tube which represents both larger diameter tube 11 and smaller diameter tube 11*a*. The inside diameter of larger diameter tube 11 is slightly larger than the outside diameter of smaller diameter tube 11*a* so tube 11*a* can telescope inside tube 11. The inside diameter of smaller tube 11 is at least slightly greater than the maximum diameter of a tennis ball 21, which is nominally 2½ inches. Thus, balls 21 may move freely inside both tubes 11 and 11*a*. The length of each of tubes 11 and 11*a* is about eighteen inches, but different lengths may be utilized.

Figure 3:
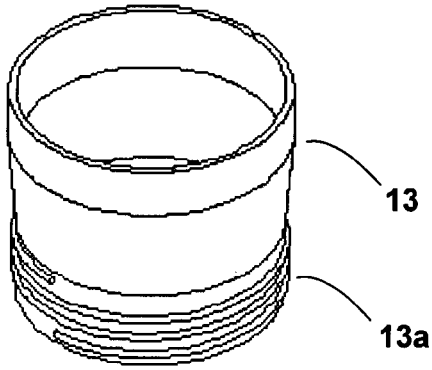
FIG. 3 is a three dimensional view of a tube enlarger used in construction of the telescoping tube of the ball retrieval, storage and dispensing device with circular cross section tubes.

In FIG. 3 is shown a tube enlarger 13 which is also shown in FIG. 1 assembled into device 10 on the end of tube 11*a* near the middle of the device 10. In FIG. 3 it can be seen that the inside top of tube enlarger 13 is smooth. Its' inside diameter is such that it just fits over an end of larger diameter tube 11. Preferably an adhesive is used to attach the two pieces together but some type of snap on mechanical arrangement may also be utilized. The outside bottom of tube enlarger 13 has threads 13*a* onto which the internal threads of coupler nut 12 are turned during compression of compression ring 17.

Figure 4:
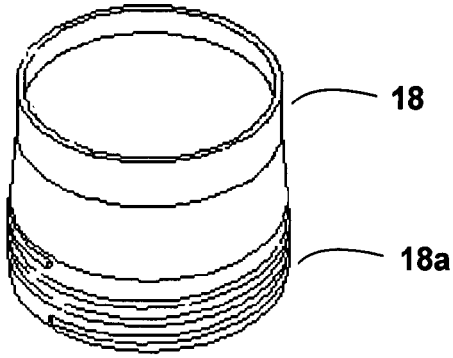
FIG. 4 is a three dimensional view of a tube reducer used in construction of the telescoping tube of the ball retrieval, storage and dispensing device with circular cross section tubes.

In FIG. 4 is shown a tube reducer 18. As seen in FIGS. 9 and 10 a tube reducer 18 is attached to either end of device 10. Preferably a tube reducer 18 is attached by an adhesive but a snap on mechanical arrangement or other mechanical fastener may be utilized. The outside of one end of tube reducer 18 has threads 18*a* onto which an entrance end cap 23 (see FIG. 7) or a closed end cap 19 (see FIG. 8) may be turned as shown in FIGS. 9 and 10. There are actually two slightly different tube reducers 18. The inside diameter of one matches the outside diameter of tube 11, and the inside diameter of the other matches the outside diameter of tube 11*a*. Since they are identical in all other respects only one depiction is shown in FIG. 4.

Figure 5:
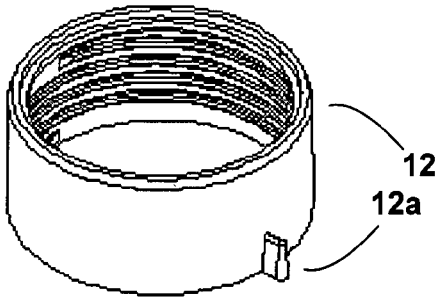
FIG. 5 shows a three dimensional view of a coupler nut used in assembling the two telescoping tube segments of the ball retrieval, storage and dispensing device with circular cross section tubes.

In FIG. 5 is shown a coupler nut 12. As previously described with reference to FIG. 1 nut 12 is slid over smaller diameter tube 11*a*, followed by a compression ring 17, and tube 11*a* is then inserted partially inside larger diameter tube 11. The threads on the inside of coupler nut 12 are then turned onto the external threads 13*a* of tube enlarger 13 to lock tubes 11 and 11*a* together. To assist in tightening coupler nut 12 onto a tube enlarger 13 there are at least two small, opposing protrusions 12*a* on the outside of coupler nut 12.

Figure 6:
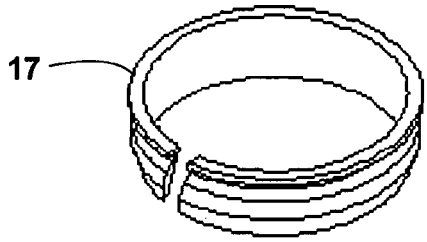
FIG. 6 is a three dimensional view of a compression ring used in assembling the two telescoping tube segments of the ball retrieval, storage and dispensing device with circular cross section tubes.

In FIG. 6 is shown a compression ring 17. Ring 17 is elastic and is squeezed between a coupler nut 12 and a tube enlarger 13 to lock tube segments 11 and 11*a* together as previously described.

Figure 7:
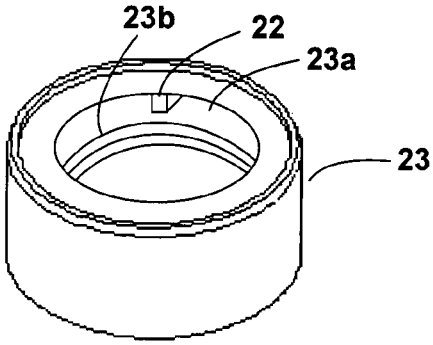
FIG. 7 is a three dimensional view of a screw on entrance end cap used with circular cross section tubes.

In FIG. 7 is shown a three dimensional view of a circular, entrance end cap 23 that is shown assembled into device 10 in FIGS. 9 and 10. Internal threads 23*b* are used to screw end cap 23 onto a tube enlarger 18 as shown in FIG. 10. Cap 23 has a hole 23*a* there through which ball 21 (not shown in this FIG. 7) must pass. The diameter of hole 23*a* is slightly smaller than the smallest diameter of a tennis ball, and a tennis ball must be squeezed in order to pass there through. While hole 23*a* is shown round it may have other shapes, such as oval or triangular, so long as the ball must be squeezed on passing there through. Fastened to the inside wall of entrance end cap 23 is a retainer 22 that is shown in and described in greater detail with reference to FIGS. 17, 18 and 19. Retainer 22 places a side ways pressure on a ball 21 after it has been squeezed through opening 23*a* that continues to squeeze the ball and prevent it from hanging downward such that part of a ball does not hang out through opening 23*a*.

Figure 8:
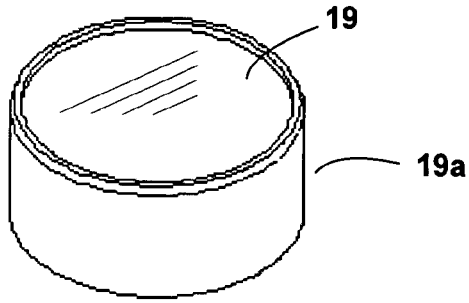
FIG. 8 is a three dimensional view of a screw on closed end cap used with circular cross section tubes.

In FIG. 8 is shown a three dimensional view of a circular, closed end cap 19 that is shown assembled onto device 10 in FIGS. 9 and 10. Internal threads alike shown in FIG. 7 are used to screw closed end cap 19 onto a tube enlarger 18 as shown in FIGS. 9 and 10. While cap 19 is screwed on as shown in FIG. 10, it may be changed to snap on to the outer end of tube 11*a*. Cap 19 is removed to remove tennis balls 21 stored inside device 10.

In FIG. 9 is shown a side view of a ball retrieval, storage and dispensing device 10 that is assembled utilizing circular tubes 11 and 11*a* and circular end caps 19 and 23. As previously described a tube enlarger 13 is glued or otherwise fastened to one end of larger diameter tube 11, and a tube reducer 18 is glued or otherwise fastened to the outer end of each of tubes 11 and 11*a*. Coupler nut 12 is first slid onto the end of tube 11*a* followed by sliding on a compression ring 11. The last mentioned end of tube 11*a* is then slid inside larger diameter tube 11 as is better seen in FIG. 10. At the user determined proper length for device 10 the threads of coupler nut 12 are screwed onto the external threads 18*a* of tube enlarger 18. As this is done compression ring 11 is compressed and tube 11*a* is locked to tube 11.

In FIG. 10 is shown a side cutaway view of a ball retrieval, storage and dispensing device 10 that is assembled utilizing circular tubes 11 and 11*a* and circular end caps 19 and 23. The basic description is the same as given in the previous paragraph for FIG. 9 so is not repeated here. However other details can better be seen in FIG. 10. For instance it can be seen how circular entrance end cap 23 is screwed into a tube reducer 18 which is adhesively attached to the outer end of tube 11. Similarly, it can be seen how circular closed end cap 19 is screwed into a tube reducer 18 which is adhesively attached to the outer end of tube 11*a*. Most importantly, it can be seen how tube 11*a* telescopes inside tube 11 and is locked in a user chosen position using coupler nut 12, compression ring 17 and tube enlarger 18.

Figure 11:
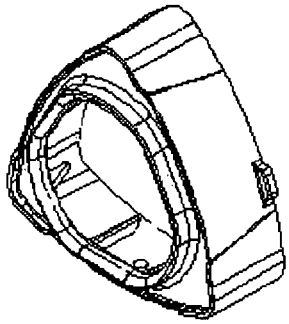
FIG. 11 is a three dimensional view of a triangular entrance end cap through which balls enter the ball retrieval, storage and dispensing device.
Figure 21:
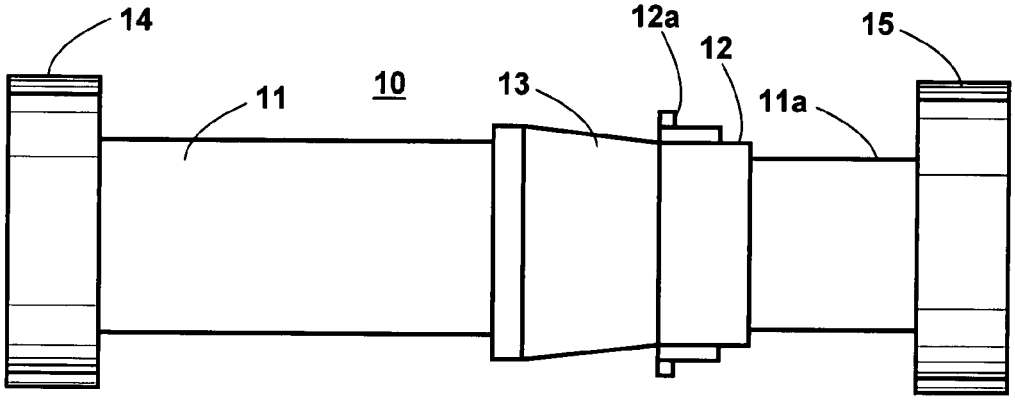
FIG. 21 is a side view of the ball retrieval, storage and dispensing device with a circular ball storage tube and triangular shaped end caps.

In FIG. 11 is shown a three dimensional view of a triangular shaped entrance end cap 14. Through the end of cap 14 is an opening 16 which has a reinforcing rim 14*a* along its edge. Cap 14 may fit on and be fastened to a circular tube 11 such as shown in FIG. 21, or onto a differently shaped tube such as shown in FIG. 15. In an alternate embodiment of the invention the ball tube 24 is not round, as shown in FIGS. 1 and 2, but has a triangular cross section such as shown in FIG. 15.

Cap 14 has a hole 16 through its end wall through which a ball 21 (not shown in this figure but seen in FIG. 16) must pass upon entering the storage tube. While hole 16 is shown generally oval in this figure it may have other shapes, such as round (FIG. 7) or triangular (FIG. 12), so long as the tennis ball 21 must be squeezed a little in order to pass through opening 16. The ball is squeezed when ball retrieval, storage and dispensing device 10 is utilized as designed and a user places opening 16 of entrance cap 14 over a tennis ball 21 and pushes downward. Once a ball 21 has passed through opening 16 it cannot pass back through opening 16 even with the weight of a number of tennis balls above it inside device 10.

Triangular entrance end cap 14 has one or more raised hemispherical dimples 20 formed inside its periphery as shown in FIG. 11. These hemispherical dimples 20 are used to attach cap 14 to a tube 11. One end of tube 11 has one or more small holes 25 through its wall as shown in FIG. 2. When tube 11 is inserted into the rear of cap 14 the holes 25 align with the dimples 20. There is an interference fit and as tube 11 is forced into the rear of cap 14 the walls of cap 14 on which the dimples are formed deform outward slightly until the dimples snap into the matching holes 25.

End cap 14 also has a small connector 14*b* formed extending from its outer surface as shown in FIG. 11. The connector 14*b* has a hole though it to which a snap of a strap (not shown) can be fastened. The strap is also connected to a like connector 15*b* extending from closed triangular end cap 15 (see FIG.

13) at the opposite end of device 10. The strap may be placed over a person's shoulder in order to carry device 10.

Figure 12:
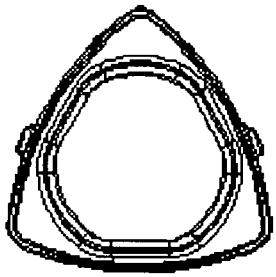
FIG. 12 is an end view of a triangular entrance end cap through which balls enter the ball retrieval, storage and dispensing device.

In FIG. 12 is shown an end view of triangular entrance end cap 14, but this cap has a triangular opening 16 instead. As previously described this triangular opening 16 is of a size that a tennis ball 21 must be squeezed a small amount to pass through the opening.

Figure 13:
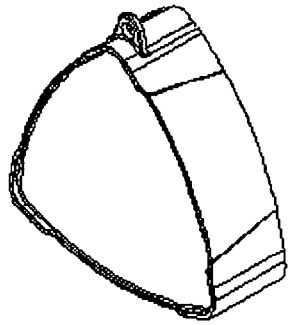
FIG. 13 is a three dimensional view of a triangular closed end cap that goes on the top of the ball retrieval, storage and dispensing device and retains balls inside the tube of the device.

In FIG. 13 is shown a three dimensional view of a triangular shaped closed end cap 15. Cap 15 may fit on and be fastened to a circular tube 11*a* (see FIG. 21), or on to a differently shaped tube (see FIG. 15). In an alternate embodiment of the invention the ball tube 24 is not round, as shown in FIGS. 1 and 2, but has a triangular cross section (see FIG. 15). Closed end cap 15 has a closed end surface 15*a* that prevent tennis balls 21 from exiting device 10 until cap 15 is removed from tube 11*a*. Cap 15 also has a small connector 15*b* extending from its outer surface as shown in FIG. 13. The connector 15*b* has a hole though it to which a snap on a strap (not shown) can be fastened. The strap is also connected to connector 14*b* extending from closed triangular end cap 14 (see FIG. 11) at the opposite end of device 10. The strap is placed over a person's shoulder to carry device 10.

Figure 14:
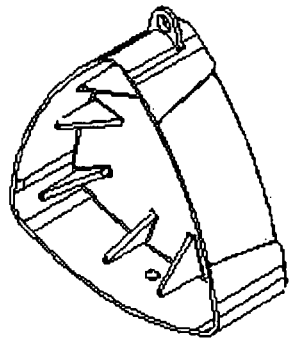
FIG. 14 is a three dimensional view of the reverse side of the triangular closed end cap that goes on the top of the device and retains balls inside the tube of the device.

FIG. 14 is a three dimensional view of the rear of triangular shaped closed end cap 15. Cap 15 also has one or more raised hemispherical dimples 20 formed inside its periphery. These hemispherical dimples 20 are used to attach cap 15 to a tube 11*a*. One end of tube 11*a* has one or more holes 25 through its wall as shown in FIG. 2. When tube 11*a* is inserted into the rear of cap 15 the holes 25 align with the dimples 20. There is an interference fit and as tube 11*a* is forced into the rear of cap 15 the walls of cap 15 deform outward slightly until the dimples snap into the matching holes 25. The triangular shape of the end caps prevents the ball retrieval, storage and dispensing device from rolling when it is laid down on the ground or other surface, no matter if the tube is round, triangular or any other shape.

FIG. 15 is a three dimensional view of a ball retrieval, storage and dispensing device 10 having triangular end caps 14 and 15 and a tube 24 that has a matching triangular cross sectional shape. This view is a contracted view showing only two tennis balls 21 inside tube 24, but in reality tube 24 would be longer and hold many more tennis balls. Although not shown in FIG. 15 tube 24 has one or more holes 25 near each of its ends that cooperate with the previously described hemispherical dimples 20 to attached end caps 14 and 15 to tube 24. It should be noted that tube 24 being of triangular cross section the ability to telescope cannot be provided. Tube 24 is of a fixed length.

The triangular tube 24 offers an advantage not found in the prior art. When the cross sectional area of the triangular tube 24 is about 1½ times the diameter of a tennis ball 21, or grater, balls inside tube 24 will be staggered with relation to each other. This permits a greater number of balls to be stored within a given length of tube 24. This also applies to larger diameter circular tubes 11 and 11*a*.

Figure 16:
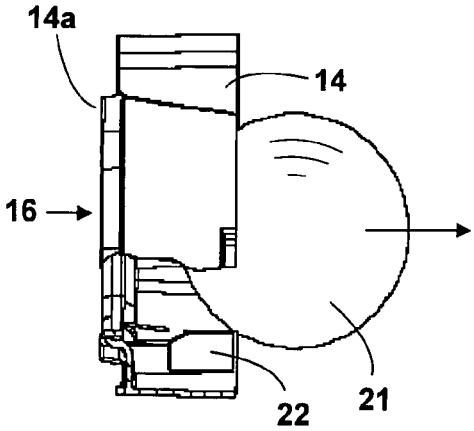
FIG. 16 is a side view of a triangular shaped entrance end cap with a ball that has entered the opening and showing the retainer tab mounted therein.

FIG. 16 shows a side view of a triangular entrance end cap 14 though the opening 16 of which has passed a tennis ball 21 into the interior of tube 11 (not shown in this figure). In accordance with the teaching of the invention there is a retainer 22 mounted on the inside side wall of entrance end cap 14. Retainer 22 is shown and described in greater detail with reference to FIGS. 17, 18, 19 and 20. Retainer 22 is positioned and sized so that it also causes tennis ball 21 to be squeezed as it passes over retainer 22. Due to the position of retainer 22 inside entrance cap 14 it squeezes tennis ball 21 while ball 21 is flush with the opening 16 through entrance end cap 14. Thus, tennis ball 21 is prevented from ever extending out through opening 16, even with the weight of other balls in device 10 on the lower most tennis ball 21. In FIG. 16 tennis ball 21 is shown past retainer 21 and past the plane of opening 16 but it can be readily appreciated that ball 21 must be squeezed in order to pass over retainer 21.

Figure 17:
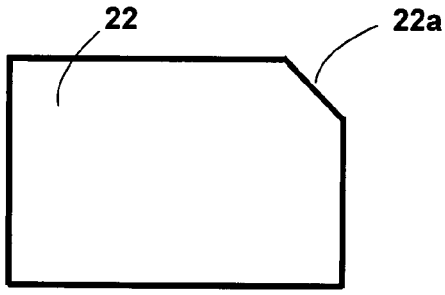
FIG. 17 is a side view of a retainer tab.

In FIG. 17 is shown a side view of retainer 22. Retainer 22 has a length of 0.75 inches, a height of 0.45 inches, and has a sloped top edge 22*a*. Sloped edge 22*a* assists in the squeezing of tennis ball 21 as it passes over retainer 22.

Figure 18:
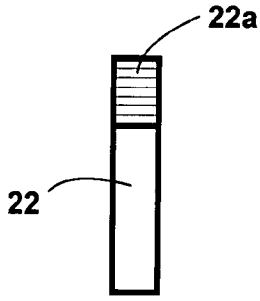
FIG. 18 is an end view of the retainer tab.

FIG. 18 shows an end view of retainer 22 showing the sloped edge 22*a*. Retainer 22 is 0.125 inch wide.

Figure 19:
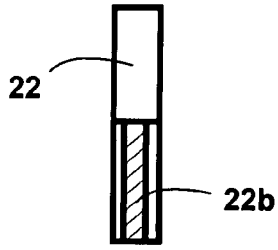
FIG. 19 is a bottom view of the retainer tab.

FIG. 19 is shown a bottom view of retainer 22. Formed in the bottom of the retainer is a groove 22*b* that is used to mount the retainer 22 inside entrance end cap 14.

Figure 20:
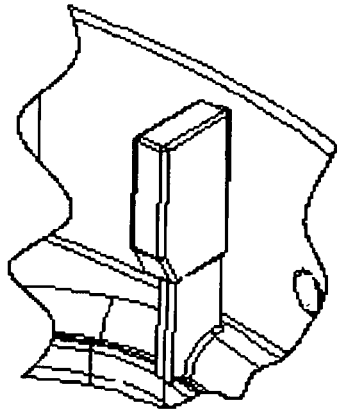
FIG. 20 is an exploded three dimensional view of the interior of a triangular shaped entrance end cap showing a retainer tab mounted therein.

FIG. 20 is shown a three dimensional view of a retainer 22 attached to one of the ridges 23 formed on the inside wall of entrance end cap 14 as is better seen in FIG. 11. Retainer 22 may be attached to a ridge 23 using an adhesive. In the view of FIG. 20 a tennis ball 21 will be traveling upward over retainer 22.

In FIG. 21 is shown a side view of a ball retrieval, storage and dispensing device 10 comprised of circular tubes 11 and 11*a* with triangular end caps 14 and 15. All the elements have previously been described so the description is not repeated her. This view is shown to show the particular combination of round tubes 11 and 11*a* with triangular end caps 14 and 15. The outside dimensions of triangular end caps 14 and 15 are such that when attached to round tubes 11 and 11*a* and the assembly is lying on the ground, the round surface of tubes 11 and 11*a* are not in contact with the ground. Accordingly, the triangular end caps 14 and 15 on device 10 prevent device 10 from rolling.

While what has been described hereinabove is the preferred embodiments of the invention those skilled in the art will understand that numerous changes may be made without departing from the spirit and scope of the invention. For example, flexible balls other than tennis balls may be picked up, stored and dispensed with the present invention.

What is claimed is:

1. A tennis ball retrieval, storage and dispensing device comprising:

a hollow tube having a lower end, an upper end, and having a cross sectional area larger than tennis balls to be placed within the hollow tube;

a closed cap on the upper end of the hollow tube for retaining tennis balls inside the device, the closed cap being removed or opened to remove tennis balls inside the hollow tube;

an entrance cap on the lower end of the hollow tube, the entrance cap having an opening through which tennis balls must pass when entering the hollow tube, wherein the opening has shape and size that causes tennis balls passing through the opening to be slightly deformed, wherein a ball having been deformed as it passes through the entrance cap opening is held inside the hollow tube; and retainer means inside the device past the opening through the entrance cap, the retainer means being on one side of the inside of the device and causing a tennis ball adjacent to the retainer means to be slightly deformed, a ball adjacent to the retainer and being deformed by the retainer remaining in a position where it is flush with the opening through the entrance cap.

2. The tennis ball retrieval, storage and dispensing device of claim 1 wherein the hollow tube comprises:

a first hollow tube having a first end and a second end and the first end is the upper end of the hollow tube; and a second hollow tube having a first end and a second end and the second end of the second hollow tube is the lower end of the hollow tube, and the second end of the first hollow tube telescopes within the first end of the second hollow tube;

wherein the entrance cap is attached to the second end of the second hollow tube, the entrance cap having an opening through which tennis balls must pass when entering the device, wherein the opening has shape and size that causes tennis balls passing through the opening to be slightly deformed which prevents the tennis balls from falling out of the device through the opening of the entrance cap;

a closed cap attached to the second end of the second hollow tube for retaining tennis balls inside the device, the closed cap being removed or opened to remove tennis balls inside the device; and means for locking the first hollow tube and the second hollow tube so they cannot telescope together.

3. The tennis ball retrieval, storage and dispensing device of claim 2 wherein the first hollow tube is cylindrical and has a first diameter, the second hollow tube is cylindrical and has a second diameter, and wherein the first diameter is less than the second diameter so the first hollow tube and the second hollow tube can telescope together.

4. The tennis ball retrieval, storage and dispensing device of claim 3 wherein the means for locking comprises:

a compression ring; and a coupler nut;

wherein the coupler nut and the compression ring cooperate to either permit the first hollow tube and the second hollow tube to telescope together to adjust the overall length of the device, or to be locked and not telescope together.

5. The tennis ball retrieval, storage and dispensing device of claim 4 further comprising:

an adapter that is attached to the first end of the second hollow tube, the adapter having threads on its external surface;

wherein the coupler nut has internal threads that match the adapter threads, and the coupler nut and the compression ring are placed over the second end of the first hollow tube just before the second end of the first hollow tube is inserted into the first end of the second hollow tube, and wherein the threads of the coupler nut are screwed onto the threads of the adapter and tightened to thereby compress the compression ring to thereby lock the first hollow tube and the second hollow tube so they cannot telescope together, and the coupler nut can be unscrewed from the adapter an amount to unlock the first hollow tube and the second hollow tube so they can telescope together.

6. The tennis ball retrieval, storage and dispensing device of claim 1 wherein the entrance cap and the closed cap both have a cross sectional shape that is generally triangular and the triangular shape prevent the device from rolling when it is laid on the ground.

7. The tennis ball retrieval, storage and dispensing device of claim 6 wherein the hollow tube has a cross sectional shape that is generally circular.

8. The tennis ball retrieval, storage and dispensing device of claim 7 wherein the cross sectional area of the hollow tube is large compared to the diameter of the tennis balls inside the hollow tube so the tennis balls orient themselves in a staggered fashion that permits a greater number of tennis balls to be held within a given length of hollow tube.

9. The tennis ball retrieval, storage and dispensing device of claim 8 wherein the retainer means facilitates the staggering of the tennis balls by putting a force on tennis balls entering the hollow tube that it transverse to the axis of the hollow tube.

10. The tennis ball retrieval, storage and dispensing device of claim 1 wherein the cross sectional area of the hollow tube is large compared to the diameter of the tennis balls inside the hollow tube so the tennis balls orient themselves in a staggered fashion that permits a greater number of tennis balls to be held within a given length of the hollow tube, and the retainer means facilitates the staggering of the tennis balls by putting a force on tennis balls entering the hollow tube that is transverse to the axis of the hollow tube.

11. A tennis ball retrieval, storage and dispensing device comprising:

a hollow tube having a lower end, an upper end, and having a cross sectional area that is large compared to the tennis balls to be placed within the hollow tube so the tennis balls orient themselves in a staggered fashion inside the hollow tube and that permits a greater number of tennis balls to be held within a given length of the hollow tube;

a closed cap on the upper end of the hollow tube for retaining tennis balls inside the device, the closed cap being removed or opened to remove tennis balls inside the hollow tube, wherein the closed cap has a cross sectional shape that is generally triangular; and an entrance cap on the lower end of the hollow tube, the entrance cap having an opening through which tennis balls must pass when entering the hollow tube of the device, wherein the opening has a shape and size that causes tennis balls passing through the opening to be slightly deformed, and wherein the entrance cap has a cross sectional shape that is generally triangular;

wherein the generally triangular shape of the closed cap and the entrance cap prevent the device from rolling when it is laid on the ground.

12. The tennis ball retrieval, storage and dispensing device of claim 11 wherein the hollow tube has a cross sectional shape that is generally triangular.

13. The tennis ball retrieval, storage and dispensing device of claim 11 wherein the hollow tube comprises:

a first hollow tube having a first end and a second end;

a second hollow tube having a first end and a second end and the second end of the first hollow tube telescopes within the first end of the second hollow tube;

wherein the entrance cap is attached to the second end of the second hollow tube and the closed cap is attached to the first end of the first hollow tube;

a compression ring; and a coupler nut;

wherein the coupler nut and the compression ring cooperate to either permit the first hollow tube and the second hollow tube to telescope together to adjust the overall length of the device, or to be locked and not telescope together.

14. The tennis ball retrieval, storage and dispensing device of claim 13 wherein the first tube is cylindrical and has a first diameter, the second tube is cylindrical and has a second diameter, and wherein the first diameter is less than the second diameter so the first tube and the second tube can telescope together.

15. The tennis ball retrieval, storage and dispensing device of claim 14 wherein the means for locking comprises:

a compression ring; and a coupler nut;

wherein the coupler nut and the compression ring cooperate to either permit the first hollow tube and the second hollow tube to telescope together to adjust the overall length of the device, or to be locked and not telescope together.

16. The tennis ball retrieval, storage and dispensing device of claim 15 further comprising:

an adapter that is attached to the first end of the second hollow tube, the adapter having threads on its external surface;

wherein the coupler nut has internal threads that match the adapter threads, and the coupler nut and the compression ring are placed over the second end of the first hollow tube just before the first end of the first hollow tube is inserted into the first end of the second hollow tube, and wherein the threads of the coupler nut are screwed onto the threads of the adapter and tightened to thereby compress the compression ring to thereby lock the first hollow tube and the second hollow tube so they cannot telescope together, and the coupler nut can be unscrewed from the adapter an amount to unlock the first hollow tube and the second hollow tube so they can telescope together.

17. A tennis ball retrieval, storage and dispensing device comprising:

a first hollow tube having a first end and a second end;

a second hollow tube having a first end and a second end and the second end of the first hollow tube telescopes within the first end of the second hollow tube;

an entrance cap attached to the second end of the second hollow tube, the entrance cap having an opening through which tennis balls must pass when entering the device, wherein the opening has shape and size that causes tennis balls passing through the opening to be slightly deformed which prevents the tennis balls from falling out of the device through the opening of the entrance cap;

a closed cap attached to the first end of the first hollow tube for retaining tennis balls inside the device, the closed cap being removed or opened to remove tennis balls inside the device;

a compression ring; and a coupler nut;

wherein the coupler nut and the compression ring cooperate to lock the first hollow tube and the second hollow tube so they cannot telescope together.

18. The tennis ball retrieval, storage and dispensing device of claim 17 further comprising:

an adapter that is attached to the first end of the second hollow tube, the adapter having threads on its external surface;

wherein the coupler nut has internal threads that match the adapter threads, and the coupler nut and the compression ring are placed over the second end of the first hollow tube just before the second end of the first hollow tube is inserted into the first end of the second hollow tube, and wherein the threads of the coupler nut are screwed onto the threads of the adapter and tightened to thereby compress the compression ring to thereby lock the first hollow tube and the second hollow tube so they cannot telescope together, and the coupler nut can be unscrewed from the adapter an amount to unlock the first hollow tube and the second hollow tube so they can telescope together.

* * * * *